US010946385B2

(12) United States Patent
Fischer et al.

(10) Patent No.: US 10,946,385 B2
(45) Date of Patent: Mar. 16, 2021

(54) ROLLER MILL, ASPIRATING ASSEMBLY, AND METHOD FOR RETROFITTING A ROLLER MILL

(71) Applicant: BÜHLER AG, Uzwil (CH)

(72) Inventors: Daniel Fischer, Schwellbrunn (CH); Daniel Rickenbach, Wittenwil (CH); Daniel Mark, Wil (CH)

(73) Assignee: BÜHLER AG, Uzwil (CH)

( * ) Notice: Subject to any disclaimer, the term of this patent is extended or adjusted under 35 U.S.C. 154(b) by 622 days.

(21) Appl. No.: 15/552,544

(22) PCT Filed: Feb. 17, 2016

(86) PCT No.: PCT/EP2016/053377
§ 371 (c)(1),
(2) Date: Aug. 24, 2017

(87) PCT Pub. No.: WO2016/135025
PCT Pub. Date: Sep. 1, 2016

(65) Prior Publication Data

US 2018/0021786 A1 Jan. 25, 2018

(30) Foreign Application Priority Data

Feb. 23, 2015 (EP) ..... 15156142

(51) Int. Cl.
*B02C 4/06* (2006.01)
*B02C 4/28* (2006.01)
*B02C 11/08* (2006.01)

(52) U.S. Cl.
CPC ..... *B02C 4/06* (2013.01); *B02C 4/286* (2013.01); *B02C 11/08* (2013.01)

(58) Field of Classification Search
CPC .... B02C 4/00; B02C 4/02; B02C 4/06; B02C 4/32; B02C 11/08
See application file for complete search history.

(56) References Cited

U.S. PATENT DOCUMENTS 3,866,842 A 2/1975 Linzberger
6,732,963 B2 * 5/2004 Kasada ..... B02C 4/06 241/135

FOREIGN PATENT DOCUMENTS

DE 1 036 019 8/1958
DE 2 403 351 9/1974
(Continued)

OTHER PUBLICATIONS

European Search Report Corresponding to 15156142.0 dated Sep. 2, 2015.

(Continued)

*Primary Examiner* — Matthew Katcoff
(74) *Attorney, Agent, or Firm* — Davis & Bujold PLLC; Michael J. Bujold

(57) ABSTRACT

A roller mill (10) for grinding material, an aspirating assembly (23; 23') and a method of retrofitting an existing roller mill. The roller mill (10) contains a grinding space (11, 11') for grinding material, a separating wall (17) separates the grinding space from an aspiration space (21, 21'). At least one aspiration opening (13), is formed in the separating wall (17) through which aspiration air can flow due to a pressure difference between the aspiration space and the grinding space. The roller mill (10) has a closing element (14) for opening and closing the aspiration opening (13). The closing element (14) is in or moves into an opening position (O), which opens the aspiration opening (13), when the pressure difference exceeds a threshold value, and is in or moves into a closing position (S), which closes the aspiration opening (13), when the pressure difference falls bellow the threshold value.

13 Claims, 6 Drawing Sheets

(56) References Cited

FOREIGN PATENT DOCUMENTS

Figure 1:
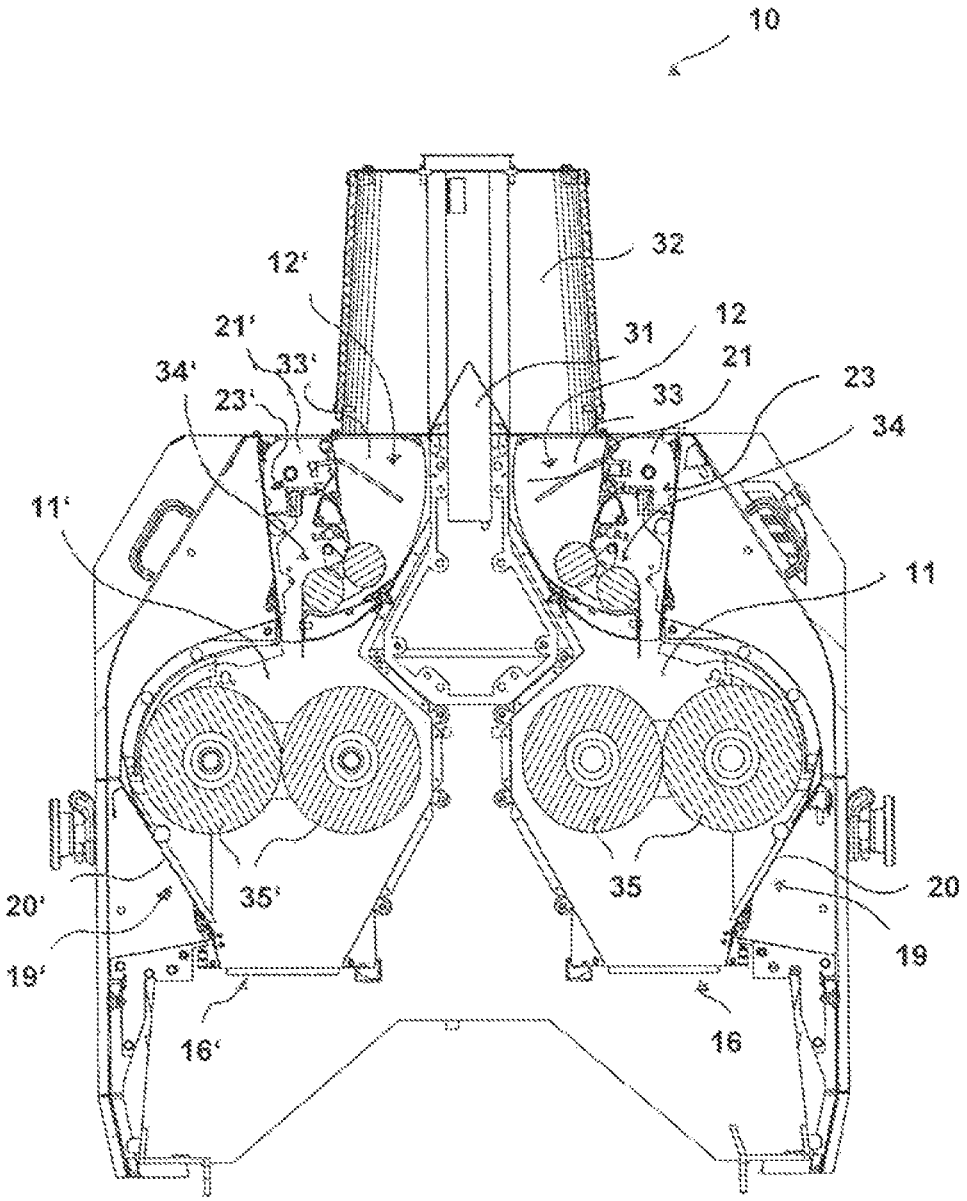

| | | | |
|---|---|---|---|
| EP | 0450337 | A2 | 10/1991 |
| GB | 221 | | 10/1909 |
| JP | S5513782 | | 4/1980 |
| JP | 2007209929 | A | 8/2007 |

OTHER PUBLICATIONS

International Preliminary Report on Patentability Corresponding to PCT/EP2016/053377 dated Sep. 8, 2017.
Indian Office Action issued in corresponding Indian Patent Application No. 201717030358 dated Sep. 13, 2019.
Korean Office Action issued in corresponding Korean Patent Application No. 10-2017-7026396 dated Feb. 18, 2019.
Japanese Office Action issued in corresponding Japanese Patent Application No. 2017-544756 dated Sep. 3, 2018.

* cited by examiner

ROLLER MILL, ASPIRATING ASSEMBLY, AND METHOD FOR RETROFITTING A ROLLER MILL

The present invention concerns roller mills for grinding grinding material, in particular cereal roller mills for grinding cereal, aspirating assemblies and also methods for retrofitting an existing roller mill.

Roller mills for grinding grinding material contain at least one grinding space, in which the grinding material, for example cereal, is ground. For this purpose, the grinding space has at least one pair of grinding rollers.

It is customary for a reduced pressure to prevail in the grinding space with respect to the ambient air pressure, which is present around the roller mill, or with respect to the air pressure in an otherwise present aspiration space, from which air flows into the roller mill. By way of example, this reduced pressure can be generated by a ventilator system, present under the grinding rollers, for blowing air out of the roller mill and/or by a pneumatic conveying system arranged in the region of the discharge of the roller mill hopper. As described in the document GB 1909 No. 221, it may be advantageous to arrange the air inlet openings between the aspiration space and the grinding space (what are termed "aspiration openings") above the grinding rollers, in order that fine dust etc. ("stive") does not collect in the upper grinding space, but rather is also drawn downward.

Nowadays, such roller mills as a rule have an inspection opening, through which the grinding space beneath the grinding rollers is accessible and, for example, samples of the ground grinding material are to be removed.

In the normal operating state, i.e. when the inspection opening is closed, a roller mill of this type functions like a roller mill without an inspection opening. Aspiration air has to be fed through the aspiration opening(s) in order to allow for the air to flow in. Aspiration openings of this type are known, for example, from the document GB 1909 No. 221.

However, the opening of the inspection opening changes the air pressure and air flow conditions in the roller mill. This fact is problematic since, in the roller mill, it should be possible for the checks which are routine during the operation of the machine to be carried out unhindered, to be precise without a change to the grinding itself and, to the extent possible, without undesirable escape of dust. A good and reliable partial solution to this problem is described in document DE 2 403 351, in which aspiration air passes from the circumferential region of a grinding roller via a suction apparatus separated from the roller mill hopper to the hopper outlet or to the pneumatic conveying line inlet. A solution preferred in DE 2 403 351 is to guide this suction apparatus along the rear wall of the hopper. In practice, a suction apparatus of this type is separated from the hopper by aspiration plates.

In many of the known apparatuses, it was therefore necessary to provide aspiration plates in order to conduct the aspiration air so that a check can be carried out without a change to the grinding itself.

An escape of relatively coarse grinding dust, e.g. from the inspection opening itself, is also prevented by these aspiration plates, present in roller mills, and the associated air flows. Specifically, the ground grinding material is usually conveyed away from a discharge of the roller mill hopper with the aid of a pneumatic conveying device. This conveying device ensures that there is a reduced pressure in the grinding space, and this ensures that the grinding dust cannot escape from the inspection opening into the environment on account of the air draft which arises when the inspection opening is opened.

Frictional heat arises from the grinding rollers during the operation of a roller mill. Said frictional heat heats the air in the grinding space to a relatively high degree. At the same time, the reduced pressure prevailing in the discharge hopper means that air is taken in through the aspiration opening and flows behind a known aspiration plate into the discharge hopper. This air has a different state to the air in front of the known aspiration plate. By way of example, the air taken in through an aspiration opening is often cooler than the air in front of the known aspiration plate. In certain conditions, this can lead to undesirable condensate formation on the known aspiration plates present in the hopper, and this results in additional cleaning expenditure.

Moreover, when the inspection opening is opened, in certain conditions dust can still escape undesirably from the aspiration opening above the grinding rollers into the environment. This leads to contamination of the environment of the roller mill. This is not just unpleasant for the user, but also necessitates additional cleaning measures. The problem concerning the escape of grinding dust is therefore partially only displaced, but in the prior art not completely eliminated.

It is therefore an object of the present invention to provide, inter alia, a roller mill in the case of which the disadvantages present in the prior art are overcome. In particular, the intention is for the roller mill to therefore be developed in such a manner that, when an inspection opening is opened, a still smaller quantity of grinding dust escapes from the roller mill into the environment, and that it is possible to dispense as far as possible with aspiration plates, in order to solve the described problem in relation to condensate formation.

This object is achieved by a roller mill for grinding grinding material, in particular a cereal roller mill for grinding cereal, as per the main claims. A roller mill according to the invention contains

- at least one grinding space, in which the grinding material, in particular the cereal, can be ground,
- at least one partition wall, which separates the grinding space from an aspiration space,
- at least one aspiration opening, which is formed in the partition wall and through which aspiration air can be drawn from the aspiration space into the grinding space on account of a pressure difference prevailing between the aspiration space and the grinding space.

The grinding space usually contains at least one pair of grinding rollers, with which the cereal can be ground.

Roller mills usually also contain a feed-in region for feeding grinding material to be ground into the grinding space. A feed-in region of this type contains a feed space, in which the grinding material to be ground can be kept ready, and also a metering device, with which the grinding material can be metered from the feed space into the grinding space. The feed-in region and in particular the feed space thereof will not be assigned to the grinding space here and hereinbelow. In particular, said partition wall and the aspiration opening thereof are therefore not formed between the aspiration space and the feed space.

According to the invention, the aspiration space is separated from the grinding space by a closable partition wall, i.e. it does not itself form part of the grinding space. The aspiration space may be formed in the interior of the roller mill. It is also conceivable, however, for the aspiration space to be formed by the environment of the roller mill. Apart from the at least one aspiration opening which is present in it, the partition wall is substantially impermeable to aspiration air, and therefore the latter can penetrate through the partition wall at most through the aspiration opening.

According to the invention, the roller mill has at least one closure element for opening and closing the aspiration opening. In this case, the closure element is designed and arranged and/or controllable in such a manner that

- it is located in an open position in which it opens the aspiration opening when the pressure difference exceeds a threshold value, and
- it is located in a closed position in which it closes the aspiration opening when the pressure difference undershoots the threshold value.

In the normal operating state, i.e. when the inspection opening is closed, a reduced pressure prevails in the grinding space, it being possible for said reduced pressure to be generated, for example, by a pneumatic conveying system arranged in the region of a discharge of the roller mill. If this pressure in the grinding space differs from the pressure in the aspiration space by more than the threshold value, the closure element is located in the open position or moves into said open position, in which the aspiration opening is opened. In this normal operating state of the roller mill, aspiration air is therefore drawn from the aspiration space into the grinding space, such that air can be fed in in order to compensate for the escape of air from the discharge.

If the inspection opening is opened, air flows through the inspection opening into the grinding space, as a result of which the pressure which prevails there increases. As a consequence, the pressure difference between the grinding space and the aspiration space undershoots the threshold value. In this state, the closure element is located in a closed position or moves into said closed position, in which the aspiration opening is closed. Consequently, aspiration air can no longer be drawn from the aspiration space into the grinding space, and therefore conversely it is also the case that grinding dust cannot escape through the aspiration opening into the environment of the roller mill.

In the case of a roller mill according to the invention, it has surprisingly been found to also be possible to dispense with previously necessary aspiration plates in the roller mill hopper and in particular with an aspiration plate which would lead to a suction apparatus as per DE 2 403 351 along a rear wall of the hopper.

In a possible variant, the closure element is controllable in such a manner that, depending on the pressure difference, it is located in the open position or the closed position or moves into one of these positions. For this purpose, the pressures in the grinding space and in the aspiration space can be directly measured with the aid of respective pressure measurement devices in the grinding space and, respectively, in the aspiration space. The pressure difference can then be calculated using a computation unit. Depending on this calculated pressure difference, the closure element can be controlled in such a way that it is located in the open position or in the closed position. As an alternative to such a direct pressure measurement sensor system, however, an indirect solution is also conceivable and encompassed by the invention, in which, for example, an inspection opening door sensor system determines whether the inspection door is open or closed, and in which the closure element is regulated or controlled under the indirect conclusion in such a manner that the closure element is closed when the inspection opening door is open and the closure element is open when the inspection opening door is closed, such that the pressure conditions between the grinding space and the aspiration space are as described above. The closure element can be controlled, for example, pneumatically or electrically.

According to the invention, it is preferable, however, if the closure element is designed as a passive closure element, which is designed and arranged in such a manner that,

- on account of the threshold value being exceeded, it is located in the open position or moves from the closed position into the open position, and,
- on account of the threshold value being undershot, it is located in the closed position or moves from the open position into the closed position.

In this preferred variant, the closure element is therefore located in or moves into the open position or closed position directly on account of the threshold value being exceeded or undershot. It is therefore possible here to dispense with the above-described pressure measurement devices, computation units and control systems.

The partition wall with the at least one aspiration opening is arranged preferably in the vicinity of the feed-in region and further preferably in the vicinity of the metering device of the feed-in region. In this way, the aspiration air can penetrate into the grinding space in the vicinity of the feed-in region or preferably in the vicinity of the metering device of the feed-in region. It is likewise preferable for the partition wall with the at least one aspiration opening to be arranged in the upper region of the grinding space, i.e. also above the grinding rollers arranged in the grinding space. As a result of this, the aspiration air can penetrate into the grinding space in the upper region of the grinding space and therefore also above the grinding rollers.

The closure element is advantageously designed and arranged in such a manner that, if the threshold value is undershot, it is located in the closed position or moves from the open position into the closed position on account of its dead weight. This design can be realized easily in structural terms and requires only at most a small degree of maintenance. Conversely, the closure element is preferably designed and arranged in such a manner that, if the threshold value is exceeded, it is located in the open position or moves from the closed position into the open position on account of the pressure difference.

As an alternative or in addition, it is also conceivable and lies within the context of the invention for the closure element to be prestressed in the direction of the open position or in the direction of the closed position. This prestress can be achieved, for instance, with at least one spring.

The closure element is preferably designed as a pivotable closure flap. In particular, this closure flap may be pivotable about a pivot axis which runs substantially horizontally. In this respect, a substantially horizontal profile is understood to mean an angle between the pivot axis and a horizontal plane which is smaller than 15°, preferably smaller than 10° and particularly preferably smaller than 5°. Moreover, the pivot axis preferably runs substantially parallel to the axes of rotation of the grinding rollers present in the grinding space. Analogously, here too "substantially parallel" means that the angle between the pivot axis and the axes of rotation of the grinding rollers is smaller than 15°, preferably smaller than 10° and particularly preferably smaller than 5°.

In many embodiments, it is advantageous if the closure flap is tilted by an angle with respect to a vertical in the closed position S. This makes it possible for the aspiration opening to be securely closed in the closed position. Said angle can lie in the range of up to 45°, preferably of up to 10°, particularly preferably of 2° to 3°.

It is conceivable and lies within the context of the invention for the partition wall to have only a single aspiration opening. However, this can lead to difficulties if said single aspiration opening has to be comparatively large so as to allow for an adequate air supply. This is because the closure element then has to be dimensioned with a corresponding size, and under certain circumstances this can lead to inadequate sealing of the aspiration opening in the closed state.

It is particularly advantageous that a plurality of aspiration openings are therefore provided in the partition wall. These aspiration openings are preferably arranged substantially along the entire length of the grinding rollers of the roller mill. An aspiration opening length of less than 100 cm, preferably of 10 cm to 20 cm, has proved to be suitable.

A respective separate closure element is preferably provided for each of the aspiration openings and is designed for opening and closing only said associated aspiration opening. Specifically, this likewise contributes to better sealing of the aspiration openings in the closed position.

In another variant, however, it is similarly conceivable for at least one closure element to be designed for simultaneously opening and closing a plurality of the aspiration openings. It is thereby possible for the number of closure elements which are required as a whole to be reduced, and this reduces the structural outlay.

Furthermore, the roller mill can have at least one securing element, which is designed and arranged in such a manner that it prevents the closure element from falling into the grinding space. It is thereby possible to prevent a situation in which, if the closure element becomes unintentionally detached, it falls into the grinding space and in particular even into the grinding gap formed between the grinding rollers. By way of example, the securing element can be designed as a securing bracket.

The roller mill can furthermore contain at least one inspection opening, through which the grinding space is accessible, for example for the removal of a sample of grinding material. Furthermore, the roller mill can contain at least one grinding space door, with which the inspection opening can be optionally opened or closed. In this case, the inspection opening, the grinding space door and the closure element are arranged and designed and matched to one another in such a manner that the pressure difference lies above the threshold value when the grinding space door is closed and lies below the threshold value when the grinding space door is open. An opening of the grinding space door therefore has the effect that the closure element is located in or moves into the closed position in which the aspiration opening is closed, such that no grinding dust can escape through said aspiration opening into the environment of the roller mill.

In order to at least temporarily generate a reduced pressure in the grinding space (i.e. an aspiration), the roller mill can moreover have reduced pressure means or can be connected or can be connectable to such reduced pressure means. By way of example, these reduced pressure means can be formed by a pneumatic conveying system, which is arranged in the region of a discharge of the roller mill and with the aid of which the ground grinding material can be conveyed away from the discharge.

The roller mill advantageously comprises at least one frame and an aspirating assembly which is detachably connected to said frame. Said aspirating assembly contains at least the at least one partition wall, the at least one aspiration opening formed in the partition wall, and the at least one closure element. The aspirating assembly is preferably designed as an elongate strip which extends in its longitudinal direction substantially along the entire length of the grinding rollers of the roller mill.

Moreover, the aspirating assembly can have a substantially rigid mount, in which the at least one aspiration opening is formed and on which the closure elements are arranged. Furthermore, the aspirating assembly can contain a securing element (as mentioned above), which is connectable, in particular detachably connectable, to the mount. Furthermore, the aspirating assembly can also have fastening means for detachably connecting the aspirating assembly to the frame of the roller mill. Furthermore, the aspirating assembly preferably contains at least one flexible seal, with which it can be applied to a boundary wall of the grinding space. The flexible seal makes it possible for the aspirating assembly to bear closely against the boundary wall, and therefore prevents passage of the aspiration air at undesirable locations. In this configuration, the mount together with the at least one seal forms the partition wall of the aspirating assembly.

The combination of the partition wall, of the aspiration opening and of the closure element and optionally of the securing element in a detachably connected aspirating assembly has the advantage that said aspirating assembly can be inserted into an existing roller mill, and, when required (for example for cleaning, maintenance or repair purposes), can be removed from the frame of the roller mill.

A further aspect of the invention is such an aspirating assembly per se. This therefore involves an aspirating assembly to be detachably connected to a frame of a roller mill, said roller mill comprising at least one grinding space, in which grinding material can be ground. The aspirating assembly contains

- at least one partition wall, which separates the grinding space from an aspiration space,
- at least one aspiration opening, which is formed in the partition wall and through which aspiration air can be drawn from the aspiration space into the grinding space on account of a pressure difference prevailing between the aspiration space and the grinding space,
- at least one closure element for opening and closing the aspiration opening, wherein the closure element is designed and arranged and/or controllable in such a manner that
  - it is located in an open position or moves into an open position in which it opens the aspiration opening when the pressure difference exceeds a threshold value, and
  - it is located in a closed position or moves into a closed position in which it closes the aspiration opening when the pressure difference undershoots the threshold value.

The at least one partition wall, the at least one aspiration opening and the at least one closure element, independently of one another, can have one, a plurality or all of the properties described above in conjunction with the roller mill according to the invention, and therefore provide for the respective advantages which are likewise explained above.

Moreover, the aspirating assembly can have one, a plurality or all of the components already mentioned above:

- a substantially rigid mount, on which the closure elements are arranged;
- at least one securing element, which is connectable, in particular detachably connectable, to the mount;
- fastening means for detachably connecting the aspirating assembly to a frame of the roller mill;

at least one flexible seal, with which the aspirating assembly can be applied to a boundary wall of the grinding space.

Finally, the invention also relates to a method for retrofitting an existing roller mill for grinding grinding material, in particular an existing cereal roller mill for grinding cereal. The existing roller mill contains at least one grinding space, in which the grinding material can be ground. According to the invention, the method contains a step in which the following components are retrofitted such that a roller mill according to the invention as described above is obtained:

at least one partition wall, which separates the grinding space from an aspiration space, at least one aspiration opening, which is formed in the partition wall and through which aspiration air can be drawn from the aspiration space into the grinding space on account of a pressure difference prevailing between the aspiration space and the grinding space, at least one closure element for opening and closing the aspiration opening, wherein the closure element is designed and arranged and/or controllable in such a manner that it is located in an open position or moves into an open position in which it opens the aspiration opening when the pressure difference undershoots a threshold value, and it is located in a closed position or moves into a closed position in which it closes the aspiration opening when the pressure difference exceeds the threshold value.

The aspiration space can be formed by retrofitting the partition wall into an interior of the roller mill. The insertion of the partition wall can therefore separate an original larger grinding space of the existing roller mill into a smaller grinding space and an aspiration space.

The at least one partition wall, the at least one aspiration opening and the at least one closure element can be inserted as separate components into the existing roller mill. It is preferable, however, if the at least one partition wall, the at least one aspiration opening formed in the partition wall, and the at least one closure element are part of a common aspirating assembly, in particular of an aspirating assembly according to the invention as described above. Specifically, said components can then be inserted together into the existing roller mill.

Figure 2:
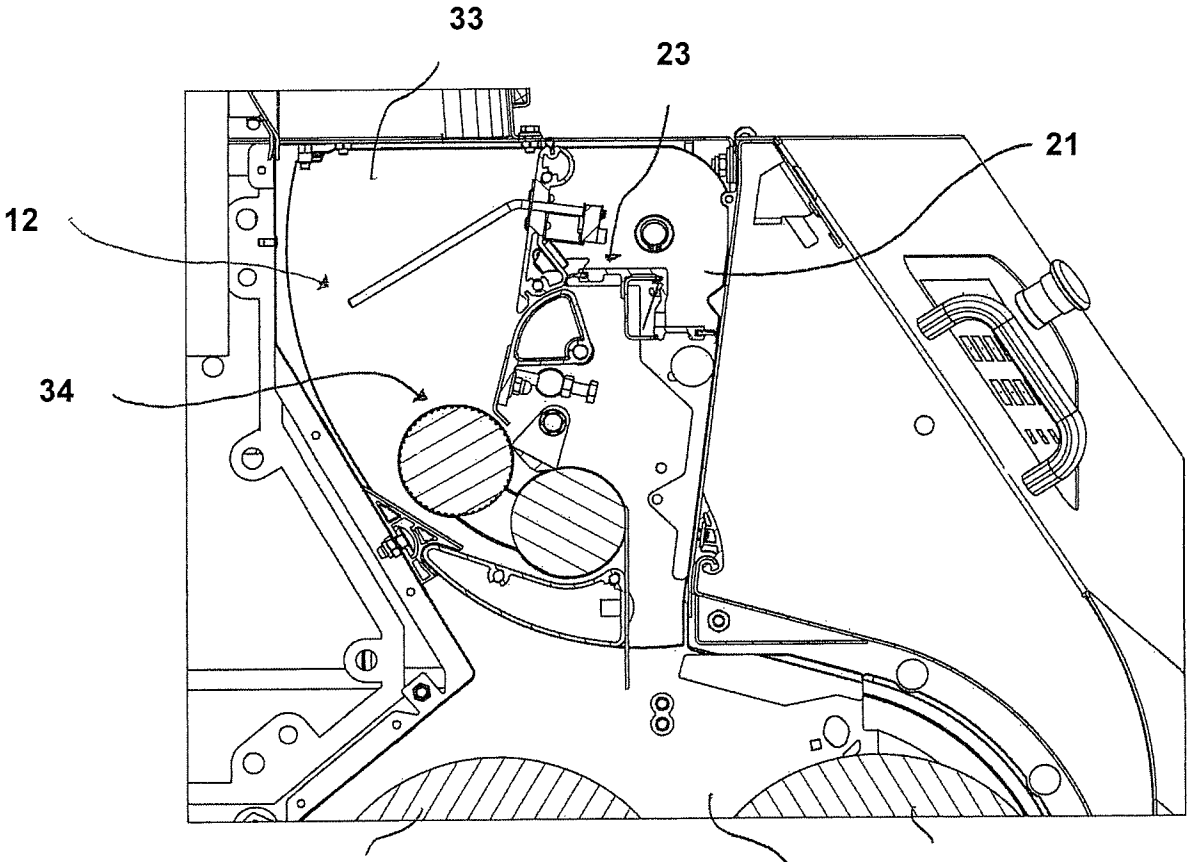
Figure 3:
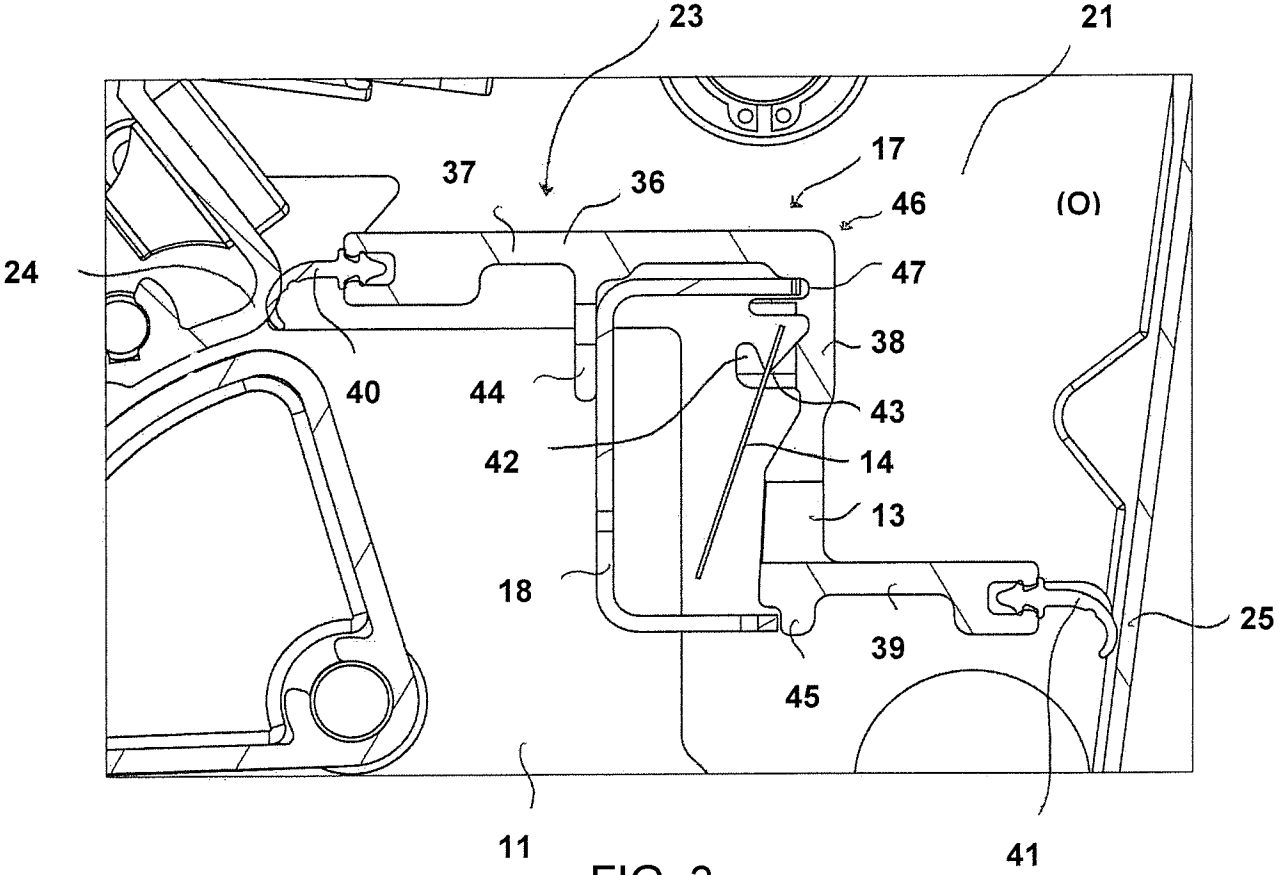
Figure 4:
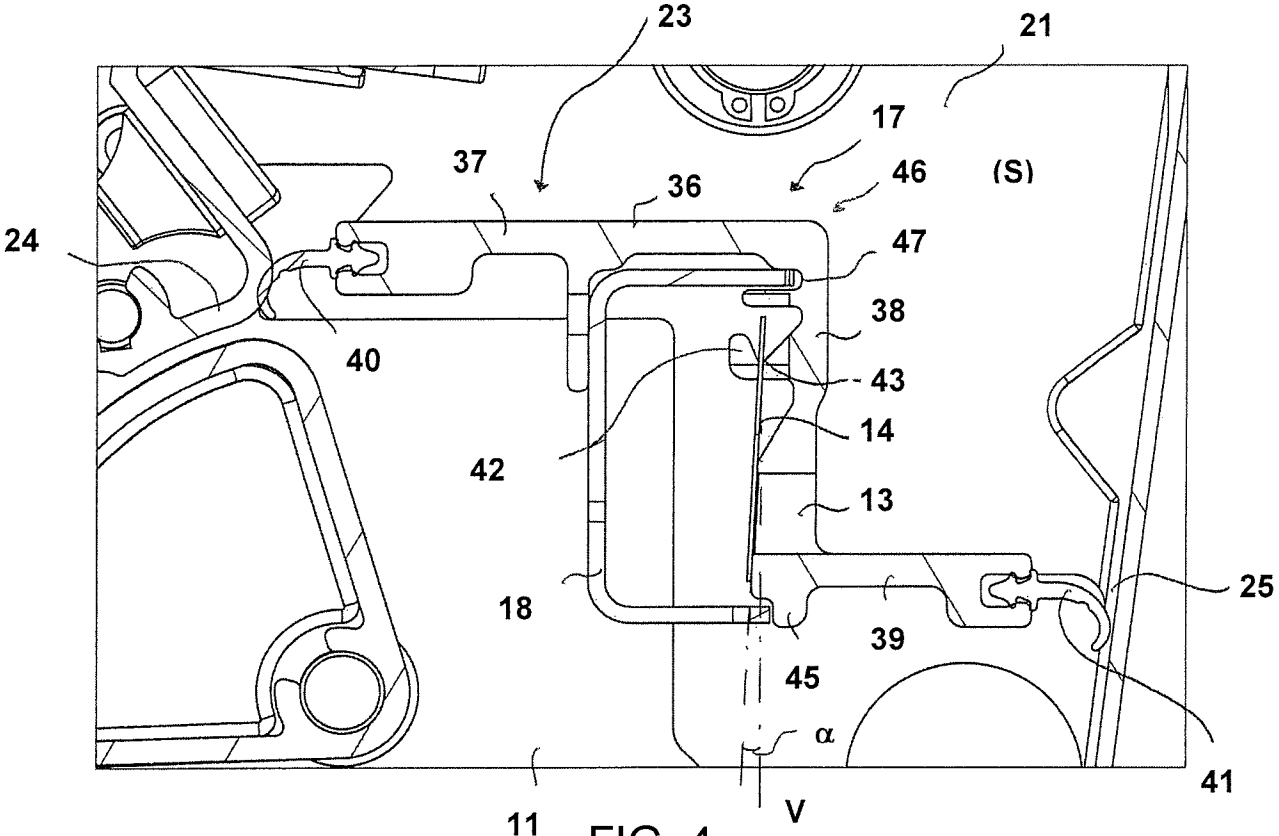
Figure 5:
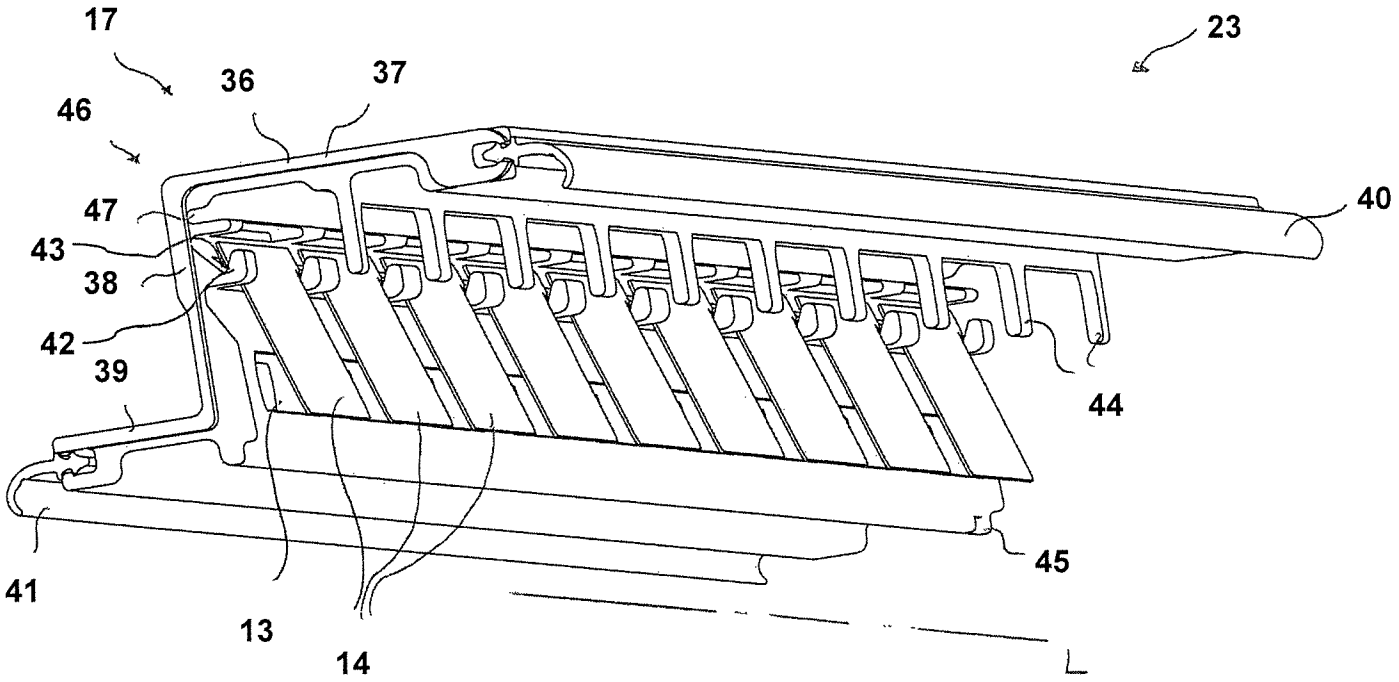
Figure 6:
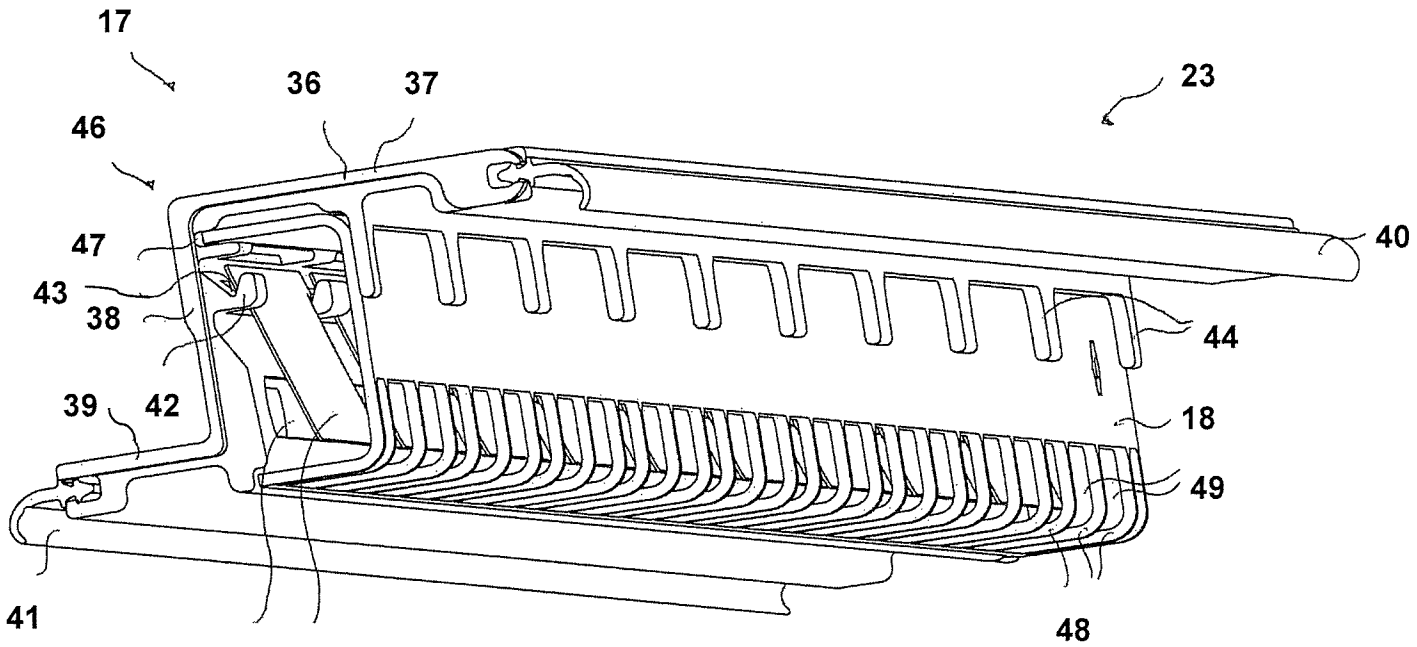

Hereinbelow, the invention will be explained in detail on the basis of an exemplary embodiment and a plurality of drawings, in which:

FIG. 1: shows a roller mill according to the invention in a lateral sectional view;

FIG. 2: shows the roller mill in an enlarged lateral sectional view;

FIG. 3: shows an aspirating assembly of the roller mill with a closure flap in an open position in a further enlarged detailed view;

FIG. 4: shows the aspirating assembly of the roller mill with the closure flap in a closed position in a further enlarged detailed view;

FIG. 5: shows the aspirating assembly without a securing bracket in a perspective view, and FIG. 6: shows the aspirating assembly with a securing bracket in a perspective view.

FIG. 1 shows a cereal roller mill 10 for grinding cereal. The roller mill 10 contains a distributing element 31 with an inlet depot 32 arranged thereabove. With the aid of the distributing element 31, cereal flowing in through the inlet depot 32 is divided into two feed spaces 33, 33' of respective feed-in regions 12, 12'. The cereal is metered into grinding spaces 11, 11' by means of respective metering devices 34, 34' of the feed-in regions 12, 12'. In said grinding spaces, said cereal is ground with the aid of respective pairs of grinding rollers 35, 35'. Aspirating assemblies 23, 23' are arranged in the vicinity of the metering devices 34, 34' and in the upper region of the grinding spaces 11, 11', i.e. in particular above the grinding rollers 16, 16', and separate the respective grinding space 11, 11' from a respective aspiration space 21, 21'. Inspection openings 19, 19' are located beneath the grinding rollers 35, 35' and, in the state shown here, are closed by respective grinding space doors 20, 20'. Finally, the cereal is conveyed away through respective discharges 16, 16' by means of a pneumatic conveying system (not shown here).

FIG. 2 once again shows, in an enlarged illustration, the feed-in region 12 with the feed space 33 and the metering device 34 and also the aspirating assembly 23, which is arranged in the upper region of the grinding space 11 and separates said grinding space 11 from the aspiration space 21.

The aspirating assembly 23 is shown once again in detail in FIG. 3. It contains a rigid mount 36, manufactured for example from aluminum, with a first horizontal portion 37, a vertical portion 38 and a second horizontal portion 39. At a first end, the first horizontal portion 37 bears with the aid of a first seal 40 against a first boundary wall 24 of the roller mill 10. The opposing end of the first horizontal portion 37 is adjoined by the upper end of the vertical portion 38. The lower end of the vertical portion 38 merges into the second horizontal portion 39, the opposing end of which bears by means of a second seal 41 against a second boundary wall 25 of the roller mill 10. Together with the first seal 40 and the second seal 41, the mount 36 therefore forms a partition wall 17, which separates the grinding space 11 from the aspiration space 21.

A first protrusion 42 with a groove-like recess 43 extends from the vertical portion 38 of the mount 36 laterally and in the direction of the first horizontal portion 37. A closure element designed as a closure flap 14 is hooked into said recess 43 (see in this respect also FIG. 5). In this way, the closure flap 14 is suspended in a pivotable manner, to be precise about a pivot axis which runs parallel to the axes of rotation of the grinding rollers 35 (i.e. perpendicular to the plane of the drawing). A plurality of aspiration openings 13, of which only one can be seen here, are present in the vertical portion 38 of the mount 36.

A second protrusion 44 extends downward from the first horizontal portion 37, and a third protrusion 45 extends downward from the second horizontal portion 39. Furthermore, a notch 47 is provided in the transition region 46 between the first horizontal portion 37 and the vertical portion 38. A securing element designed as a securing bracket 18 is fixedly clamped on the mount 36 by means of the second protrusion 44, the third protrusion 45 and the notch 47, and prevents the closure flap 14 from falling into the grinding space 11.

In the state shown in FIGS. 1 to 3, the grinding space door 20 closes the inspection opening 19, and the pneumatic conveying system adjoining the discharge 16 generates a reduced pressure in the grinding space 11. Since this reduced pressure arises only in the grinding space 11 but not in the aspiration space 21 as well, a pressure difference is formed between the aspiration space 21 and the grinding space 11. This pressure difference has the effect that the closure flap 14 is pivoted against its dead weight and thus opens the aspiration opening 13. As a result of this, aspiration air is drawn from the aspiration space 21 into the grinding space 11. This inflowing aspiration air compensates for the air stream withdrawn at the discharge 16 by means of the pneumatic conveying system. The open position O of the closure flap 14 is therefore present in FIG. 3.

If the grinding space door 20 is then opened, air flows through the grinding space door 20 into the grinding space 11 on account of the reduced pressure which prevails in the grinding space 11. Since the pressure which prevails in the aspiration space 21 does not change in the process, the pressure difference between the aspiration space 21 and the grinding space 11 drops below a threshold value, and therefore the closure flap 14 moves from the open position O shown in FIG. 3 into the closed position S shown in FIG. 4 on account of its dead weight. In this closed position S, the closure flap 14 closes the aspiration opening 13. Therefore, aspiration air can no longer be drawn from the aspiration space 21 into the grinding space 11. Above all, however, no grinding dust can escape out of the grinding space 11 into the environment from the aspiration opening 13. The closure of the closure flap 14, which results in this advantageous effect, is therefore effected as it were automatically when the grinding space door 20 is opened; further operating steps are therefore not required.

In order that the closure flap 14 can securely close the aspiration opening 13 in the closed position S, the position of the recess 43, the shape of the closure flap 14, and that part of the vertical portion 38 of the mount 36 which surrounds the aspiration opening 13 are matched to one another in such a manner that the closure flap 14 is tilted by a small angle of $\alpha=2.87°$ with respect to a vertical V in the closed position S, in which it bears against the horizontal portion 38.

If the grinding space door 20 is then closed again, the pneumatic conveying system once again draws air from the discharge 16. Since, however, further air can then no longer flow into the grinding space 11 through the inspection opening 19, the closure flap 14 moves back into the open position O shown in FIG. 3 on account of the pressure difference which then prevails again between the aspiration space 21 and the grinding space 11. This is therefore also effected solely by operating the grinding space door 20.

FIG. 5 shows the aspirating assembly 23 according to the invention separately in a perspective view, but here initially without the securing bracket 18 (this is shown only in FIG. 6). As can be seen in FIG. 5, the aspirating assembly 23 is designed as an elongate strip which extends along a longitudinal direction L. In the inserted state of the aspirating assembly 23, this longitudinal direction L runs in a horizontal direction and parallel to the axes of rotation of the grinding rollers 11.

The vertical portion 38 and the second horizontal portion 39 of the mount 36 and also the two seals 40, 41 are designed with a profiled shape; in other words, they each have a constant cross section along the longitudinal direction L. With the exception of the aspiration openings 13, the first horizontal portion 37 is also designed with a profiled shape.

The first protrusions 42 extending from the vertical portion 38 and the second protrusions 44 extending from the first horizontal portion 38 are not designed with a profiled shape, however, but instead are only present at individual discrete locations. Each of the closure flaps 14 is arranged between two respectively adjacent first protrusions 42. At the upper end, each of the closure flaps 14 has two lateral extensions, which are hooked into the recesses 43 of these two adjacent first protrusions 42. The closure flaps 14 can therefore be pivoted about the recesses 43.

FIG. 6 shows the aspirating assembly 23 together with the securing bracket 18, which is fixedly clamped on the mount 36. In the lower region, said securing bracket has a multiplicity of struts 48, between which there are formed slots 49. These slots 49 are dimensioned in such a manner that aspiration air flowing in through the aspiration openings 13 can pass through said slots 49, but unintentionally detached closure flaps 14 cannot fall through said slots into the grinding space 11.

The invention claimed is:

1. A roller mill for grinding grinding material, said roller mill comprising:

at least one grinding space in which the grinding material can be ground, at least one partition wall which separates the grinding space from an aspiration space, at least one aspiration opening which is formed in the at least one partition wall and through which aspiration air can be drawn from the aspiration space into the grinding space on account of a pressure difference prevailing between the aspiration space and the grinding space, wherein the roller mill has at least one closure element for automatically opening and automatically closing the aspiration opening, and the closure element is either designed and arranged in such a manner or is controllable in such a manner, that:

the closure element is automatically located in an open position or automatically moves into an open position in which the closure element opens the aspiration opening when the pressure difference exceeds a threshold value, the closure element is automatically located in a closed position or automatically moves into a closed position in which the closure element closes the aspiration opening when the pressure difference undershoots the threshold value, and wherein the roller mill comprises at least one inspection opening, through which the grinding space is accessible, and also at least one grinding space door, with which the inspection opening can be opened or closed, the inspection opening, the grinding space door and the closure element are arranged and designed and matched to one another in such a manner that the pressure difference lies above the threshold value, when the grinding space door is closed, and lies below the threshold value, when the grinding space door is open.

2. The roller mill according to claim 1, wherein the roller mill is a cereal roller mill for grinding cereal.

3. The roller mill according to claim 1, wherein the closure element is designed as a passive closure element, which is designed and arranged in such a manner that:

on account of the threshold value being exceeded, the closure element is automatically located in the open position or automatically moves from the closed position into the open position, and, on account of the threshold value being undershot, the closure element is automatically located in the closed position or automatically moves from the open position into the closed position.

4. The roller mill according to claim 3, wherein the closure element is designed and arranged in such a manner that, if the threshold value is undershot, the closure element is automatically located in the closed position or automatically moves from the open position into the closed position on account of its dead weight.

5. The roller mill according to claim 1, wherein the closure element is designed as a pivotable closure flap.

6. The roller mill according to claim 1, wherein a plurality of aspiration openings are provided in the at least one partition wall, through which openings aspiration air can be drawn from the aspiration space into the grinding space on account of a pressure difference prevailing between the aspiration space and the grinding space.

7. The roller mill according to claim 6, wherein a respective separate closure element is provided for each of the aspiration openings and is designed for automatically opening and automatically closing only said associated aspiration opening.

8. The roller mill according to claim 1, wherein the roller mill comprises at least one securing element, which is designed and arranged in such a manner that the at least one securing element prevents the closure element from falling into the grinding space.

9. The roller mill according to claim 1, wherein the roller mill contains a component which is configured to reduce pressure, for at least temporarily generating a reduced pressure in the grinding space, or is connected or can be connected to such reduced pressure means.

10. The roller mill according to claim 9, wherein the component which is configured to reduce pressure is a pneumatic conveying system, which is arranged in the region of a discharge of the roller mill and with an aid of which the ground grinding material can be conveyed away from the discharge.

11. The roller mill according to claim 1, wherein the roller mill comprises at least one frame and an aspirating assembly, which is detachably connected to the frame and contains at least the at least one partition wall, the at least one aspiration opening formed in the at least one partition wall, and the at least one closure element.

12. The roller mill according to claim 1, wherein the closure element is controllable either pneumatically or electrically.

13. The roller mill according to claim 1, wherein the at least one inspection opening is located beneath a pair of grinding rollers of the grinding mill.

* * * * *